US005649652A

United States Patent [19]

Sackett et al.

[11] Patent Number: 5,649,652

[45] Date of Patent: Jul. 22, 1997

[54] CLOTHES HANGER WITH STORAGE HOOK

[76] Inventors: Eleanor L. Sackett, 114 Third Ave. SE., Stewartville, Minn. 55976; Gary F. Krofchalk, 9322 Chimneysweep La., Dallas, Tex. 75243

[21] Appl. No.: 601,299

[22] Filed: Feb. 16, 1996

[51] Int. Cl.[6] ..... A47G 25/38; A47G 25/14

[52] U.S. Cl. ..... 223/85; 223/94; 223/DIG. 4

[58] Field of Search ..... 223/85, 92, 88, 223/DIG. 4, 89, 94; D6/315

[56] References Cited

U.S. PATENT DOCUMENTS

| | | | |
|---|---|---|---|
| D. 210,259 | 2/1968 | Holtzman | D80/8 |
| 1,551,769 | 5/1924 | Paddington . | |
| 2,077,251 | 1/1937 | Moore | 223/88 |
| 2,428,820 | 1/1947 | Therrien | 223/88 |
| 2,465,576 | 3/1949 | Colburn | 223/89 |
| 2,503,367 | 4/1950 | Weckstein | 223/92 |
| 2,701,082 | 2/1955 | Cohen | 223/85 |
| 3,860,154 | 1/1975 | Atkins | 223/88 |
| 3,963,154 | 6/1976 | Schwartz et al. | 223/85 |
| 4,029,239 | 6/1977 | Dolan | 223/92 |
| 4,063,670 | 12/1977 | Faarbech | 223/92 |
| 4,074,838 | 2/1978 | Blasnik et al. | 223/85 |
| 4,624,396 | 11/1986 | Universe | 223/DIG. 4 |
| 4,728,016 | 3/1988 | McPhee | 223/85 |
| 4,885,920 | 12/1989 | Larson | 223/92 |
| 5,074,445 | 12/1991 | Chen | 223/85 |
| 5,085,357 | 2/1992 | Chew | 223/DIG. 4 |
| 5,137,191 | 8/1992 | Blanchard et al. | 223/92 |
| 5,328,068 | 7/1994 | Shannon | 223/DIG. 4 |

*Primary Examiner*—Bibhu Mohanty

*Attorney, Agent, or Firm*—Harris, Tucker & Hardin, P.C.

[57] ABSTRACT

A clothes hanger with a storable hook provides convenient suspension of a garment therefrom without being limited as to length by a neck opening of the garment. In a preferred embodiment, a clothes hanger has a hook portion which is rotatable relative to a body portion, and which is pivotably storable in the body portion. The body portion is hollow and includes two sides which, when joined together, permit both rotatable and pivotable attachment of the hook portion to the body portion and form an opening through which the hook portion may be inserted into the body portion.

9 Claims, 3 Drawing Sheets

10
14
18
30
20
22
12
16
20
16

10a
17
19
21
20b
23
18b
22b
12b
23
20b
19
21
17

16
24
20
22
28
14
28
12
26
20
22
10
24
16

CLOTHES HANGER WITH STORAGE HOOK

BACKGROUND OF THE INVENTION

The present invention relates generally to clothes hangers and, in a preferred embodiment thereof, more particularly provides a clothes hanger having a storable hook.

A conventional clothes hanger is typically inserted through a neck opening of a garment and into shoulder areas of the garment. The garment is then suspended from the hanger with the hanger extending between the shoulder areas and a hook portion of the hanger extending upwardly through the neck opening. For this reason, clothes hangers are typically shaped so that they resemble human shoulders.

Most clothes hangers have hooks which have a fixed position. Such a hook is typically aligned with the hanger body and is effective, for example, in hanging the garment on a rod in a closet. With the hook positioned centrally between the hanger's shoulder portions, the neck opening of the garment limits the length of the hanger's shoulder portions, since each of the shoulder portions must be inserted through the neck opening.

Unfortunately, many garments, such as sweaters and other knitted clothes, will take on the shape of the clothes hangers from which they are suspended. This problem is particularly acute when clothes hangers are short and thin, and is evidenced by "points" on the shoulder areas of the garments after being suspended from these hangers. What is needed is a long clothes hanger with a relatively large rounded surface from which to suspend the garment.

A problem is experienced when clothes hangers are used to hang crew neck sweaters or clothes having non-expandable neck openings. To hang the clothes, the hanger is held at an angle and a first end inserted through the neck opening and into one shoulder area of the garment until the hook stops forward movement of the hanger. The second end is then inserted into the other shoulder area. However, to fit the second end through the neck opening, the neck opening often has to be expanded. For buttoned shirts and other clothes having expandable neck openings, this is not a problem. For crew neck sweaters, the neck opening has to be undesirably stretched, and for clothes with non-expandable neck openings, it cannot be done. If the hook was storable, the reduced clearance needed for insertion of the hanger would allow the entire hanger to be inserted into the neck opening, thereby eliminating the need to stretch the neck opening.

Some people prefer to hang clothes by inserting the hanger into the opening at the bottom of the garment and bringing it up to the shoulder areas. Again, the presence of the hook makes this type of hanging difficult because of the ease with which the hook is snagged on the clothes. Again, a storable hook would eliminate this problem.

The hook also makes hangers very difficult to store or to pack in suitcases. A storable hook would make the task of storing hangers much easier.

Some clothes hangers are known in the art which have hooks that are not rigidly fixed. For example, the following U.S. patents disclose hangers having hooks which rotate about an axis longitudinally aligned with the hangers'shoulder portions: U.S. Pat. No. 2,428,820 to Therrien, U.S. Pat. No. 1,551,769 to Paddington, and U.S. Pat. No. 3,860,154 to Atkins. The following U.S. patents disclose hangers having hooks which rotate about a vertical axis: U.S. Pat. No. 4,074,838 to Blasnik et al., U.S. Pat. No. 3,963,154 to Schwartz et al., U.S. Pat. No. 5,074,445 to Chen, and U.S. Pat. No. 2,465,576 to Colburn. The following U.S. patents disclose hangers having hooks which rotate about a horizontal axis orthogonal to the hangers'shoulder portions: U.S. Pat. No. 2,701,082 to Cohen, U.S. Pat. No. 5,074,445 to Chen, and U.S. Pat. No. D210,259 to Holtzman.

Hook rotation about the vertical axis enables a clothes hanger to be hooked over a surface which is aligned with the hanger shoulder portions, such as a door or back of a chair, permitting the garment to lay flat adjacent the door or chair back, etc. Hook rotation about a horizontal axis enables the hook to be stored proximate the hanger's body portion.

From the foregoing, it can be seen that it would be quite desirable to provide a clothes hanger which has a length which is not limited by the garment's neck opening, but which has relatively long and smoothly contoured shoulder portions. It would also be quite desirable to provide a clothes hanger having a hook which is rotatable about a vertical and a horizontal axis. It is accordingly an object of the present invention to provide such a clothes hanger.

SUMMARY OF THE INVENTION

In carrying out the principles of the present invention, in accordance with an embodiment thereof, a clothes hanger is provided which is a relatively long, hollow, and curved cylinder, and a storable and pivotable hook, utilization of which aids in eliminating the problems of misshapen garments caused by short, thin hangers, problems associated with stretching neck openings of clothes, and storing such hangers. The hook of the clothes hanger is storable within the body of the hanger.

In broad terms, a clothes hanger is provided which includes a hook portion and a body portion. The hook portion has a hook, a spherical end, and a shaft extending between the hook and the spherical end.

The body portion includes two sides, each of the sides having an interior surface and a spherical depression formed on the interior surface. The sides are joined together with the spherical end between the spherical depressions, such that the hook portion is rotatable about a vertical axis and pivotable about a horizontal axis relative to the body portion. An opening formed between the sides is capable of receiving the hook portion therein, such that the hook portion is storable in the opening.

A device for suspending a garment having a neck opening and two opposing shoulder areas, the neck opening having a length is also provided. The device includes a hook, a body, and a means for storing the hook. The body has opposing shoulder portions, and an opening formed thereon. Each of the shoulder portions has a length greater than the length of the neck opening.

Additionally, a clothes hanger comprising a hook portion and first and second sides is provided. The hook portion includes a hook, a shaft extending outwardly from the hook, and a spherical end attached to the shaft opposite the hook.

The first and second sides each include an interior surface, a peripheral edge, and a spherical depression formed on the interior surface. The peripheral edge has an interface surface, an opening portion, and a projection formed on the peripheral edge. The interface surface, spherical depression, and projection of each side are aligned so that when the first and second side interface surfaces are joined together, the opening portions form an opening therebetween, the spherical end is disposed between the spherical depressions, the hook portion is pivotably receivable in and pivotably extractable from the opening, and the projections are capable of releasably securing the shaft against pivoting movement relative to the opening while permitting rotational movement of the shaft relative to the opening.

The use of the disclosed clothes hanger permits garments, such as sweaters, to be suspended without causing "points" in the garments'shoulder areas. The clothes hanger is also versatile in that it has a hook which both rotates about a vertical axis and pivots about a horizontal axis.

DETAILED DESCRIPTION

Figure 1:
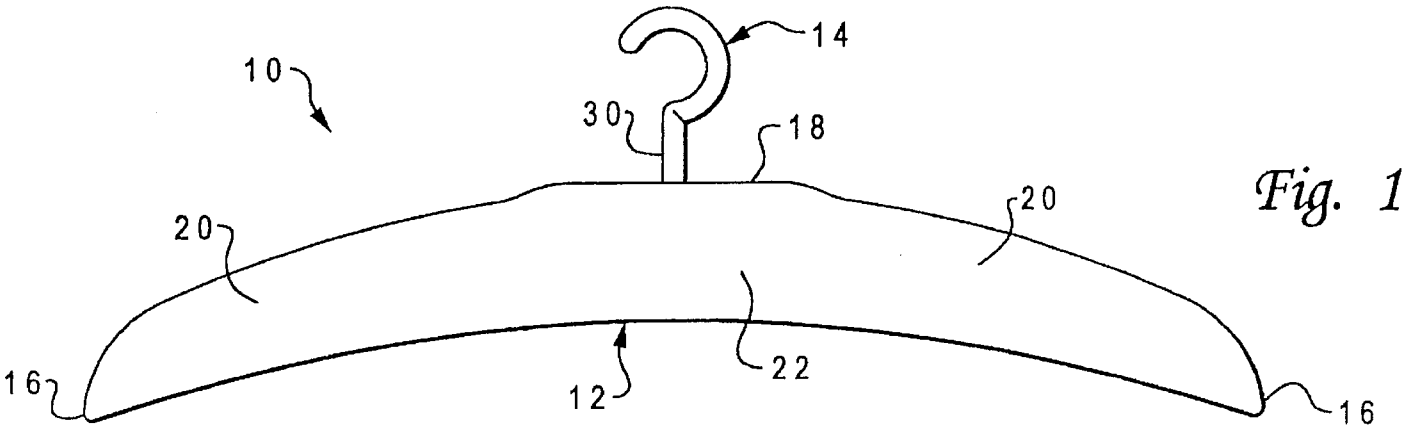
FIG. 1 is a side elevational view of a clothes hanger embodying principles of the present invention.

In the following detailed description, directional terms, such as "upwardly", "downwardly", "horizontal", and "vertical", refer to the invention as shown in the accompanying drawings. It is to be understood that the present invention is operative in orientations other than those shown in the drawings.

Illustrated in FIGS. 1–3B is a clothes hanger 10 which embodies principles of the present invention. The clothes hanger 10 includes a body portion 12 and a hook portion 14. The hook portion 14 is disposed midway between opposite ends 16 of the body portion 12. The hanger 10 has a length between the hook portion 14 and each opposite end 16 which is not limited by the length of a garment's neck opening, as will be readily understood by consideration of the following description.

Figure 1A:
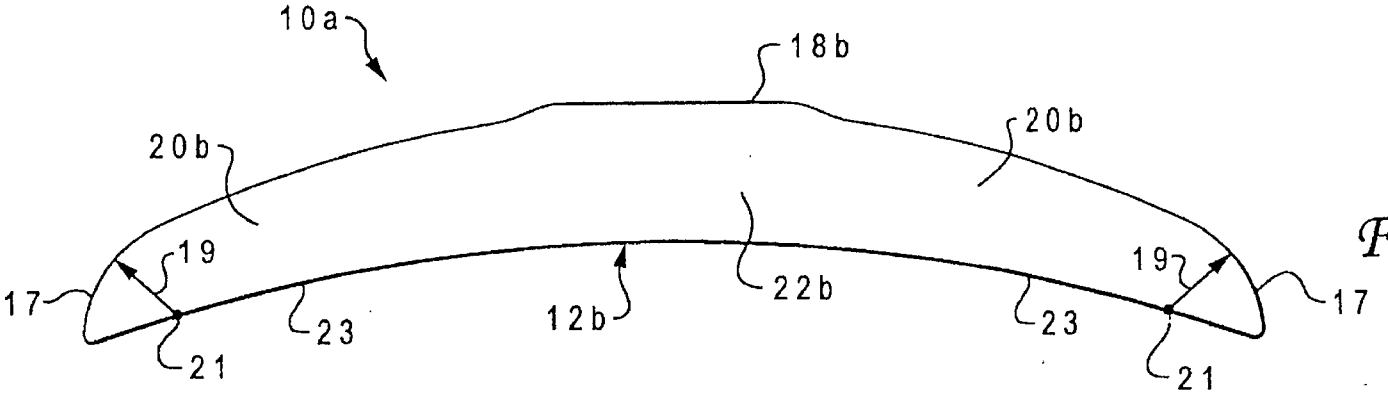
FIG. 1A is a side elevational view of another version of the clothes hanger embodying principles of the present invention.

Alternate opposite ends 17 are shown in FIG. 1A, wherein another version of the clothes hanger 10a having elements of the previously described clothes hanger 10 which perform similar functions identified with the same reference numeral, but with an added suffix "b". Ends 17 provide a larger upwardly facing radius 19 from which to suspend garments, as compared to ends 16 of hanger 10. To achieve a maximum length radius, radius 19 preferably has a center point 21 at or near a lower surface 23 of the body 12*a*. Thus, ends 17 act to further prevent bulges in shoulder areas of garments suspended therefrom.

Returning now to the description of the hanger 10, the body portion 12 is a generally cylindrical member which is hollow and has spherical opposite ends 16. The body portion 12 has a curved shape, opening concavely downward. A central neck portion 18 extends upwardly from the body portion 12. Shoulder portions 20 extend outwardly from the neck portion 18. When operatively installed into the garment, the neck portion 18 will extend upwardly through the garment's neck opening and the shoulder portions 20 will extend into the shoulder areas of the garment.

Figure 3A:
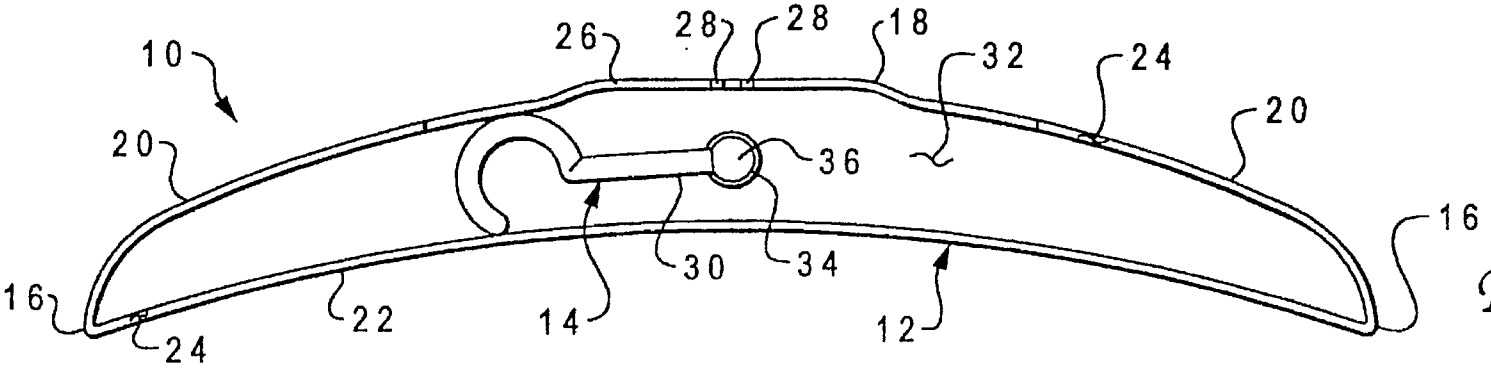
FIG. 3A is a side elevational view of the clothes hanger with a body side removed, showing the hook portion pivoted about a horizontal axis and in a stored position.

The shoulder portions 20 are relatively long and, thus, provide a larger supporting area on which to suspend the garment. The lengths of the shoulder portions 20 are not limited by the size of the garment's neck opening due to the unique manner in which the hook portion 14 may be pivoted and stored within the body portion 12 as shown in FIG. 3A. The hook portion 14 may be stored within the body portion 12 and the hanger 10 inserted entirely within the garment's neck opening. The neck portion 18 is then positioned in the neck opening with the shoulder portions 20 within the shoulder areas. The hook portion 14 is then pivoted upwardly to hang the garment on a rod, door, etc.

Figure 2:
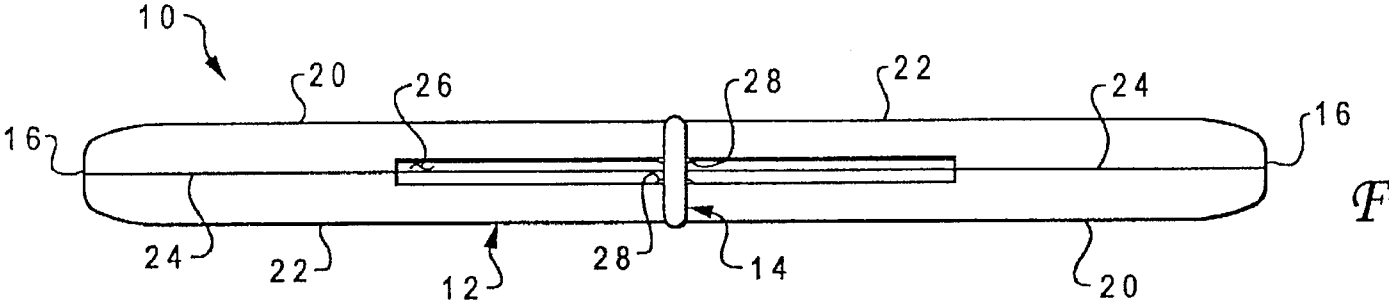
FIG. 2 is a top plan view of the clothes hanger, showing a hook portion of the hanger rotated about a vertical axis.

The body portion 12 has two sides 22 which are joined together by a suitable method, preferably adhesive bonding, at peripheral interface surfaces 24. A hook opening 26 is formed when sides 22 are joined, permitting the hook portion 14 to be pivoted downwardly into the body portion 12 between the sides 22 as shown in FIG. 3A. Laterally extending projections 28 releasably secure the hook portion 14 shaft 30 in a vertical position as shown in FIGS. 1 and 2.

On inner side surfaces 32 of the body sides 22, concave spherical depressions 34 are formed. When the body sides 22 are joined together, as described hereinabove, the depressions 34 form therebetween a spherical cavity in which a spherical end 36 of the hook portion 14 is received. By joining the sides 22 together with the spherical end 36 between the depressions 34, the hook portion 14 is pivotably and rotatably attached to the body portion 12.

Figure 3B:
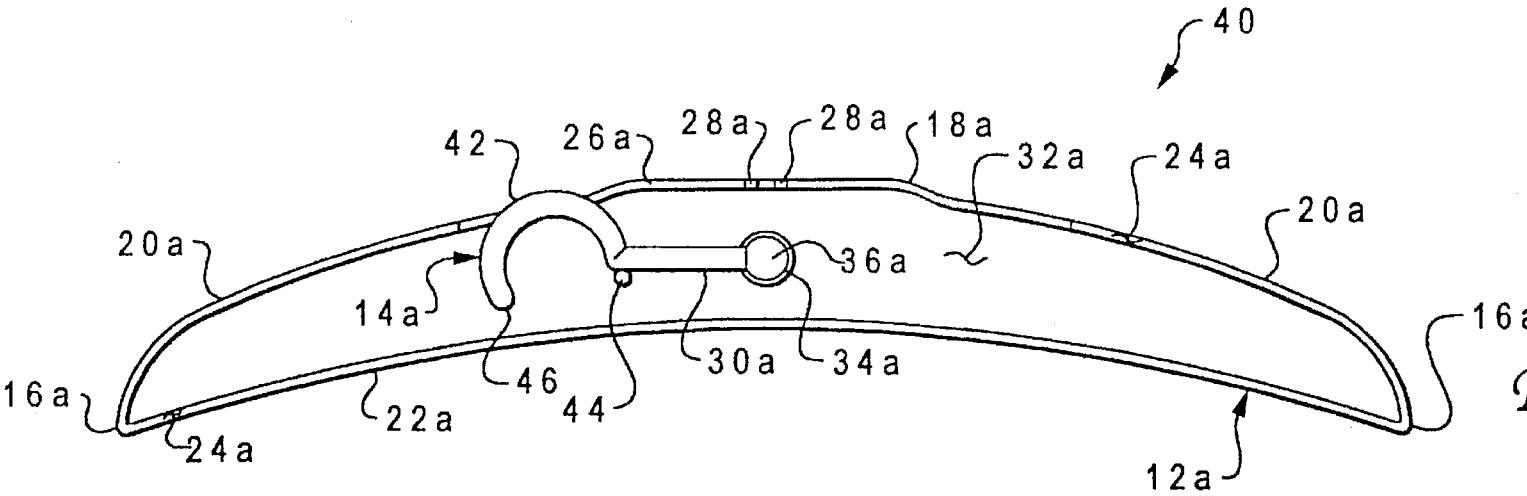
FIG. 3B is a side elevational view of the clothes hanger with a body side removed, showing an alternate configuration of the hanger.

Referring additionally now to FIG. 3B, an alternate configuration of the hanger 40 is shown. For convenience, and for clarity of description, those elements of the hanger 10*a* representatively illustrated in FIG. 3B, which are substantially similar to elements representatively illustrated in FIG. 3A, are indicated in FIG. 3B using the same reference numerals as previously used, with an added suffix "a".

Hanger 40 includes a hook portion 14*a* which extends partially outwardly through opening 26*a* when the hook portion is stored within the body portion 12*a*. This feature permits the hook portion 14*a* to be conveniently grasped for extension from the body portion 12*a* when desired.

Hook portion 14*a* may include an enlarged section 42 which has a width greater than a width of the opening 26*a*, thereby preventing the enlarged section from passing through the opening. One or both of the inner side surfaces 32*a* may have a projection 44 formed thereon, which abuts the hook portion 14*a* when it is pivoted downwardly. Tip 46 of the hook portion 14*a* may also be elongated so that it abuts one or both of the body sides 22*a*, thereby preventing the hook portion from pivoting further downwardly into the body portion 12*a*.

Figure 4:
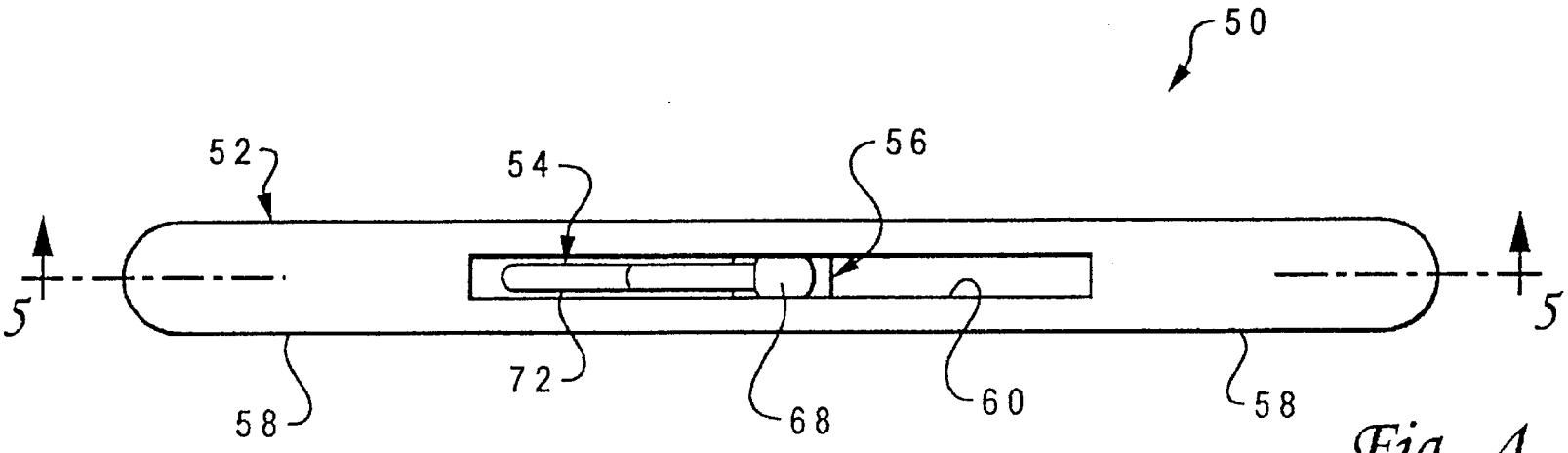
FIG. 4 is a top plan view of another clothes hanger embodying principles of the present invention.
Figure 5:
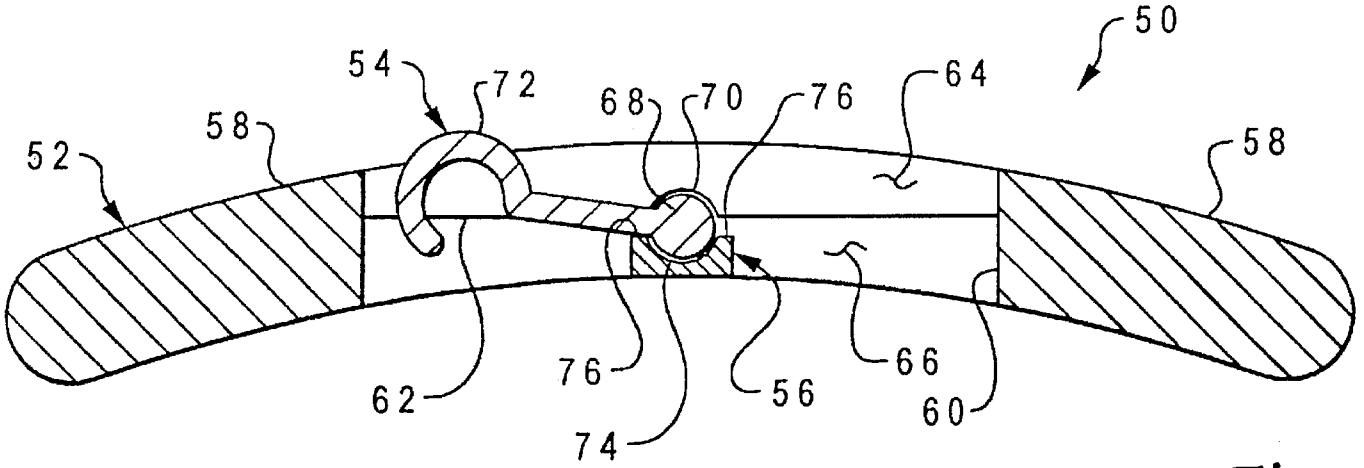
FIG. 5 is a cross-sectional view of the clothes hanger of FIG. 4, taken along line 5—5 of FIG. 4.

Turning now to FIGS. 4 and 5, another embodiment of a clothes hanger 50 embodying principles of the present invention is representatively illustrated. FIG. 5 shows a cross-sectional view of the hanger 50, taken through line 4—4 of FIG. 4. Hanger 50 includes a body 52, a hook 54, and a retainer 56.

Body 52 has an elongated downwardly curved shape with laterally extending opposite shoulder portions 58. Laterally intermediate the shoulder portions 58 an inner cavity 60 is formed through the body 52. A step 62 separates an upper, laterally narrowed, portion 64 of the cavity 60 from a lower, laterally widened, portion 66 of the cavity.

The hook 54 is received in the cavity 60 and has a spherical end 68 in cooperative engagement with a complementarily-shaped curved portion 70 formed on the step 62. Spherical end 68 is too large to pass through the narrow portion 64 of the cavity 60, but is received in the widened portion 66. Upper hook portion 72 of the hook 54 may pass through both widened and narrow portions 64 and 66 of the cavity 60.

The retainer 56 is received in the widened portion 66 and disposed such that the spherical portion 68 is intermediate the curved portion 70 of the step 62 and a complementarily-shaped curved portion 74 formed on the retainer. The retainer 56 is secured in place in the cavity 60 with glue or other fastening means. Opposite end portions 76 formed on the retainer 56 prevent the upper hook portion 72 from being downwardly pivoted completely into the cavity 60, so that it may be easily grasped and pivoted upwardly when desired.

The hook 54 may, thus, be pivoted upwardly out of the cavity 60, the spherical end 68 pivoting between the curved portions 70 and 74. The hook 54 may also, when upper hook portion 72 is out of the cavity 60, rotate about a vertical axis, the spherical end 68 rotating between the curved portions 70 and 74.

Each of the above-described elements of the clothes hangers 10, 40, and 50 is preferably made of a suitable molded plastic material, although other materials may be utilized without departing from the principles of the present invention.

The foregoing detailed description is to be clearly understood as being given by way of illustration and example only, the spirit and scope of the present invention being limited solely by the appended claims.

What is claimed is:

1. A clothes hanger, comprising:

a hook portion having a hook, a spherical end, and a shaft extending between said hook and said spherical end;

a body portion including two sides, each of said sides having an interior surface and a spherical depression formed on said interior surface, said sides being joined together with said spherical end between said spherical depressions, such that said hook portion is rotatable about a vertical axis and pivotable about a horizontal axis relative to said body portion, and an opening formed between said sides capable of receiving said hook portion therein, such that said hook portion is storable in said opening; and inwardly extending projections formed on said sides adjacent said opening, said projections releasably securing said shaft aligned with the vertical axis.

2. The clothes hanger according to claim 1, wherein said body portion further includes a neck portion and two opposing shoulder portions extending outwardly from said neck portion, said neck portion being disposed intermediate said shoulder portions.

3. The clothes hanger according to claim 2, wherein said body portion is a hollow, generally cylindrical member having a downwardly concave curved shape.

4. The clothes hanger according to claim 3, wherein each of said sides have an interface surface formed thereon and said sides are adhesively joined together at said interface surfaces of said sides.

5. A device for suspending a garment, the garment having a neck opening and two opposing shoulder areas, the neck opening having a length, the device comprising:

a hook;

a body having opposing shoulder portions, each of said shoulder portions having a length greater than the length of the neck opening, said body having sides which define an opening formed thereon;

said hook being rotatable about a vertical axis and pivotable about a horizontal axis relative to said body;

inwardly extending projections formed on said sides, said projections releasably securing said shaft aligned with the vertical axis; and means for storing said hook in said opening.

6. The device according to claim 5, wherein said storing means comprises a spherical end attached to said hook and disposed within a spherical depression formed interiorly within said body, said hook being pivotable about said spherical end and insertable into said opening.

7. The device according to claim 6, wherein said hook has a spherical end attached thereto, and said plurality of sides, when joined together, further form a spherical depression therebetween, said spherical end being received therein.

8. A clothes hanger, comprising:

a hook portion having a hook, a shaft extending outwardly from said hook, and a spherical end attached to said shaft opposite said hook; and first and second sides, each of said sides having an interior surface, a peripheral edge, and a spherical depression formed on said interior surface, said peripheral edge having an interface surface, an opening portion, and a projection formed on said peripheral edge, said interface surface, spherical depression, and projection of each side being aligned so that when said first and second side interface surfaces are joined together, said opening portions form an opening therebetween, said spherical end is disposed between said spherical depressions, said hook portion is pivotably receivable in and pivotably extractable from said opening, and said projections are capable of releasably securing said shaft against pivoting movement relative to said opening while permitting rotational movement of said shaft relative to said opening.

9. The clothes hanger according to claim 8, wherein said first and second sides, when joined together, form a hollow, generally cylindrically-shaped body, said opening permitting said hook portion to be placed in a first position wherein said hook portion extends outwardly from said body and a second position wherein said hook portion is disposed entirely within said body.

* * * * *